US008833217B2

(12) United States Patent
Smith

(10) Patent No.: US 8,833,217 B2
(45) Date of Patent: Sep. 16, 2014

(54) METHODS AND SYSTEMS TO DRIVE ROTARY PRESSES

(75) Inventor: Gregory S. Smith, McPherson, KS (US)

(73) Assignee: The Bradbury Company, Inc., Moundridge, KS (US)

( * ) Notice: Subject to any disclaimer, the term of this patent is extended or adjusted under 35 U.S.C. 154(b) by 304 days.

(21) Appl. No.: 12/139,113

(22) Filed: Jun. 13, 2008

(65) Prior Publication Data

US 2008/0307939 A1 Dec. 18, 2008

Related U.S. Application Data

(60) Provisional application No. 60/944,330, filed on Jun. 15, 2007.

(51) Int. Cl.

| | |
|---|---|
| ***B26D 7/00*** | (2006.01) |
| ***B21D 5/08*** | (2006.01) |
| ***B26D 9/00*** | (2006.01) |
| ***B26F 1/14*** | (2006.01) |
| ***B26D 5/00*** | (2006.01) |
| ***B30B 15/14*** | (2006.01) |
| ***B30B 3/00*** | (2006.01) |
| ***B26F 1/08*** | (2006.01) |
| *B26D 7/01* | (2006.01) |

(52) U.S. Cl.

CPC ... *B26F 1/14* (2013.01); *B21D 5/08* (2013.01); *B26D 9/00* (2013.01); *B26D 7/018* (2013.01); *B26D 5/00* (2013.01); *B30B 15/148* (2013.01); *B30B 3/00* (2013.01); *B26F 1/08* (2013.01); *B30B 15/146* (2013.01)

USPC ..... 83/49; 83/370; 83/360; 83/371; 83/345; 83/347; 83/471.1

(58) Field of Classification Search

USPC ..... 83/49, 52, 300, 301, 303, 321, 328, 83/335, 343, 345–347, 356.1, 356.3, 357, 83/471.1, 471.2, 556, 591, 592, 593, 598

See application file for complete search history.

(56) References Cited

U.S. PATENT DOCUMENTS 309,433 A * 12/1884 Baillie ..... 83/300
1,487,662 A * 3/1924 Langston ..... 83/120

(Continued)

FOREIGN PATENT DOCUMENTS

DE 4107036 9/1991
DE 4107036 A1 9/1991

(Continued)

OTHER PUBLICATIONS

European Patent Office, "European Search Report," issued in connection with European application serial No. 0801927.5, issued Aug. 5, 2010, 13 pages.

(Continued)

*Primary Examiner* — Omar Flores Sanchez

(74) *Attorney, Agent, or Firm* — Hanley, Flight & Zimmerman, LCC.

(57) ABSTRACT

Methods and systems to drive rotary presses are described. In one described example, a rotary press system includes a first rotary press and a second rotary press adjacent to the first rotary press. The first and the second rotary presses are to receive a strip of material. A drive member is operatively coupled to the first and the second rotary presses and a motor coupled to the drive member rotates the drive member to cause the first and second rotary presses to process the strip material.

22 Claims, 9 Drawing Sheets

(56) References Cited

U.S. PATENT DOCUMENTS

| | | | | | |
|---|---|---|---|---|---|
| 2,261,315 | A | * | 11/1941 | Thorsen | 83/303 |
| 2,445,174 | A | | 7/1948 | Hannewald et al. | |
| 3,745,864 | A | * | 7/1973 | Watson | 83/295 |
| 3,831,502 | A | * | 8/1974 | Tokuno | 493/353 |
| 3,861,260 | A | | 1/1975 | Kesten et al. | |
| 4,027,517 | A | | 6/1977 | Bodnar | |
| 4,027,564 | A | * | 6/1977 | Yahara | 83/328 |
| 4,204,449 | A | | 5/1980 | Kersting et al. | |
| 4,387,614 | A | * | 6/1983 | Evans | 83/38 |
| 4,471,641 | A | * | 9/1984 | Mitchell | 72/132 |
| 4,485,713 | A | | 12/1984 | Dotta | |
| 4,553,418 | A | | 11/1985 | Stoehr et al. | |
| 4,724,732 | A | * | 2/1988 | Miyauchi et al. | 83/37 |
| 5,080,012 | A | | 1/1992 | Fischer et al. | |
| 5,713,256 | A | * | 2/1998 | Keeny | 83/26 |
| 6,205,898 | B1 | * | 3/2001 | Surina | 83/76 |
| 8,176,821 | B2 | * | 5/2012 | Taillardat | 83/331 |
| 2005/0103171 | A1 | * | 5/2005 | Bradbury | 83/13 |

FOREIGN PATENT DOCUMENTS

| | | | |
|---|---|---|---|
| EP | 0153089 | | 8/1985 |
| EP | 1533089 | | 5/2005 |
| EP | 1533089 | A1 | 5/2005 |
| EP | 2631047 | A2 | 8/2013 |
| FR | 2537489 | | 6/1984 |
| JP | 2000177896 | | 6/2000 |
| JP | 2003154634 | | 5/2003 |
| WO | 0108875 | A1 | 2/2001 |

OTHER PUBLICATIONS

European Patent Office, "Partial European Search Report," issued in connection with European application serial No. 08010927.5, completed Feb. 19, 2010, 8 pages.

European Patent Office, "Office Communication," issued in connection with European application serial No. 08 010 927.5, issued May 12, 2011, 5 pages.

Australian Patent Office, "Examination Report," issued in connection with Australian application serial No. 2008202657, issued Feb. 19, 2013, 2 pages.

Australian Patent Office, "Notice of Acceptance," issued in connection with Australian Patent Application No. 2008202657, mailed Jul. 30, 2013, 3 pages.

European Patent Office, "Communication Pursuant to Article 93(3) EPC," issued in connection with European Patent Application No. 08 010 927.5-1702, mailed on Jun. 20, 2013, 3 pages.

European Patent Office, "European Search Report," issued in connection with European Patent Application No. 13002668.5, mailed on Jun. 28, 2013, 8 pages.

Australian Patent Office, "Patent Examination Report No. 1," issued in connection with Australian Patent Application No. 2008202657, mailed Jul. 27, 2012, 4 pages.

* cited by examiner

METHODS AND SYSTEMS TO DRIVE ROTARY PRESSES

RELATED APPLICATIONS

This patent claims the benefit of U.S. Provisional Application Ser. No. 60/944,330, filed on Jun. 15, 2007, which is incorporated herein by reference in its entirety.

FIELD OF THE DISCLOSURE

The present disclosure relates generally to rotary presses, and more particularly, to methods and systems to drive rotary presses.

BACKGROUND

Rotary presses are often used in connection with mass production or manufacturing systems to cut (e.g., pre-notch, punch, shear, etc.) material such as, for example, sheet material, strip material, continuous web material, etc. For example, rotary presses can be used in connection with roll-forming systems, which move a strip material through successive pairs of rollers that progressively bend and form the strip material to a desired shape and cross-section. A rotary press can be used to perform a series of operations prior to roll-forming the strip material to facilitate producing a desired product. Such operations may include cutting, pre-notching, punching and/or shearing the strip material. Unlike a standard material press, which requires material to be stationary when shearing or punching the material, a rotary press can cut non-stationary material, thereby, eliminating the need to stop the material each time a cutting operation is performed. This allows the material to maintain a relatively continuous forward movement through a post process such as a roll-forming process.

A traditional rotary press is driven by a respective drive member such as, for example, a motor. The motor causes opposing upper and lower press rams to move along substantially circular paths in opposing directions so that the upper and lower rams come together at a cutting point (e.g., a shearing point, a punching point, a nip point, etc.). When the upper and lower rams meet at the cutting point, the rams are moving in the direction of the material flow to enable cutting the material as it moves.

DETAILED DESCRIPTION

In general, the example methods and systems described herein drive a rotary press system to process a strip material. In particular, the rotary press system includes a first rotary press operatively coupled to a second rotary press that are driven via a common drive member that causes the first and the second rotary presses to process the strip material. Each of the first and the second rotary presses may include different cutting tools such as, for example, a punching tool, a shearing tool, and/or any combination thereof, etc. Alternatively, the first and the second rotary presses may include a cutting tool such as, for example, a die platen, to produce large patterns, multiple patterns, different patterns, etc., when processing the strip material. The example rotary press systems can be configured via, for example, a controller, a processor, etc., to provide synchronized operation between the first and the second rotary presses thereby requiring less down time or maintenance time to adjust, balance and/or synchronize the example rotary press systems. Thus, when the example rotary press systems described herein are coupled to subsequent processes such as roll-forming processes, the example rotary press systems increase the overall output of the material forming process.

Additionally, providing the rotary press system with a common drive motor substantially reduces the overall foot print (e.g., floor space area) that would otherwise be required if a first rotary press and a second rotary press were provided with respective drive motors and respective sets of drive gears. Decreasing the foot print or the required floor space area can increase production by increasing the number of production lines that can be installed in a particular area.

Figure 1:
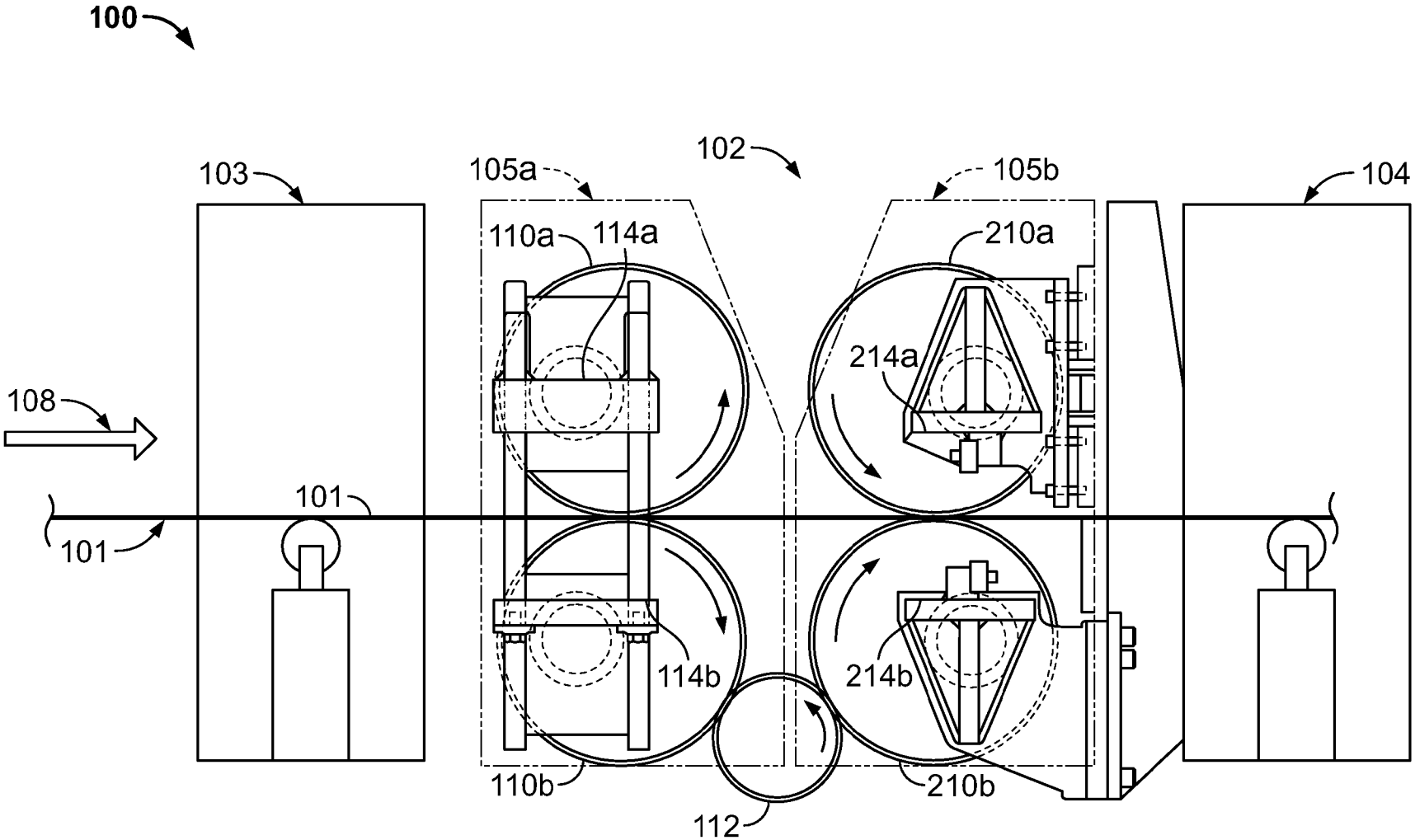
FIG. 1 is a side view of an example production system configured to process a moving material using an example rotary press system.

FIG. 1 is a side view of an example production system 100 configured to process a moving material 101 using an example rotary press system 102. In some example implementations, the example production system 100 may be part of a continuously moving material manufacturing system, which may include a plurality of subsystems that modify or alter the material 101 using processes that, for example, punch, shear, and/or fold the material 101. The material 101 may be a metallic strip material supplied on a roll or may be any other metallic or non-metallic material.

In the illustrated example, the example rotary press system 102 may be disposed between a first operating unit 103 and a second operating unit 104. The material 101 travels through the first operating unit 103, the rotary press system 102, and the second operating unit 104 in a direction generally indicated by arrow 108. The first operating unit 103 may be a continuous material delivery system that transports the material 101 to the rotary press system 102. Additionally, the first and second operating units 103 and 104 may be any desired type of process associated with a continuously moving material manufacturing system or the like.

As shown, the rotary press system 102 includes a first rotary press 105*a* and a second rotary press 105*b*. Each of the rotary presses 105*a* and 105*b* is configured to perform one or more material altering processes (e.g., cutting processes) on the material 101 as it moves through the example production system 100. For example, the rotary presses 105*a* and 105*b* may be configured to shear, punch, and/or otherwise cut or penetrate the material 101. In some example implementations, the rotary press system 102 may use conventional cutting tools such as those used in standard material presses. In the illustrated example, the first rotary press 105*a* is configured to punch the material 101 and the second rotary press 105*b* is configured to shear the material 101 without stopping the material 101. However, in other example implementations, both of the rotary presses 105*a* and 105*b* may be configured to punch or shear the material 101, or the first rotary press 105*a* may be configured to shear and the second rotary press 105*b* may be configured to punch the material 101.

During operation, the first rotary press 105*a* receives the material 101 from the first operating unit 103 and shears, punches or otherwise cuts or penetrates the material 101. The second rotary press 105*b* receives the material 101 from the first rotary press 105*a* and shears, punches or otherwise cuts or penetrates the material 101. The second operating unit 104 may then receive the processed (e.g. cut) material from the second rotary press 105*b*. For example, after the first rotary press 105*a* and the second rotary press 105*b* have sheared, punched, or otherwise cut or penetrated the material 101, the material 101 may be taken away or moved away in a continuous manner from the second rotary press 105*b* by the second operating unit 104. Alternatively, the first operating unit 103 may be configured to drive or propel the processed material 101 through the first rotary press 105*a* and the second rotary press 105*b* and toward the second operating unit 104.

As described above, the rotary press system 102 may be used within a production system such as the example production system 100. Alternatively, the rotary press system 102 may be used as a standalone system. Additionally, the rotary presses 105*a* and 105*b* may be configured to shear, punch, or otherwise cut or penetrate any continuously moving material including, for example, steel, aluminum, other metallic materials, plastic, fiberglass, wire, cable, etc.

As shown by way of example in FIG. 1, the first rotary press 105*a* includes an upper spur gear 110*a* that is directly engaged to (e.g., meshes with) a lower spur gear 110*b*. An upper ram 114*a* and a lower ram 114*b* are rotatably coupled to the upper spur gear 110*a* and the lower spur gear 110*b*, respectively. The rams 114*a* and 114*b* may be mechanically coupled to material penetration or cutting devices such as, for example, conventional cutting tools (i.e., punch and die sets, cut-off blade and cut-off ram sets) or other types of cutting tools. Additionally, the rams 114*a* and 114*b* are configured to provide sufficient structural strength to maintain their structural integrity while impacting (e.g., cutting) the material 101 as it moves (e.g., continuously) through the rotary press 105*a*. The second rotary press 105*b* includes components 210*a*, 210*b*, 214*a* and 214*b* which are substantially similar or identical to respective ones of the components 110*a*, 110*b*, 114*a*, 114*b* of the first rotary press 105*a*.

Figure 2A:
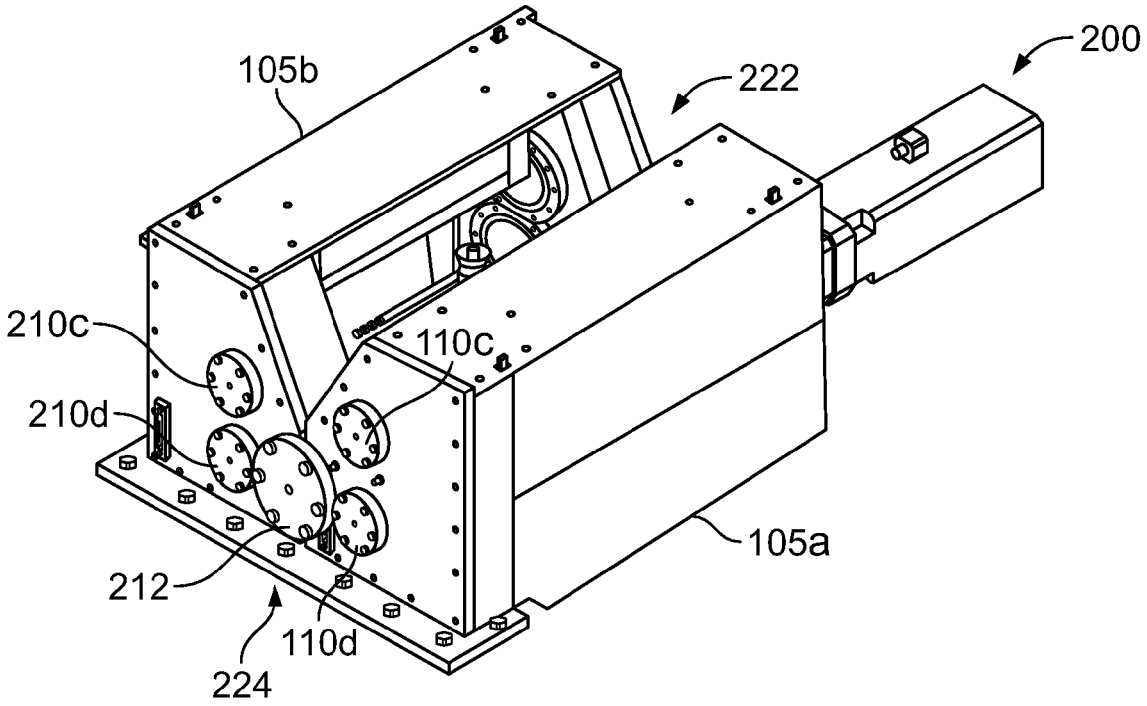
FIG. 2A is an elevated view and FIG. 2B is an isometric view of the example rotary press system of FIG. 1.
Figure 2B:
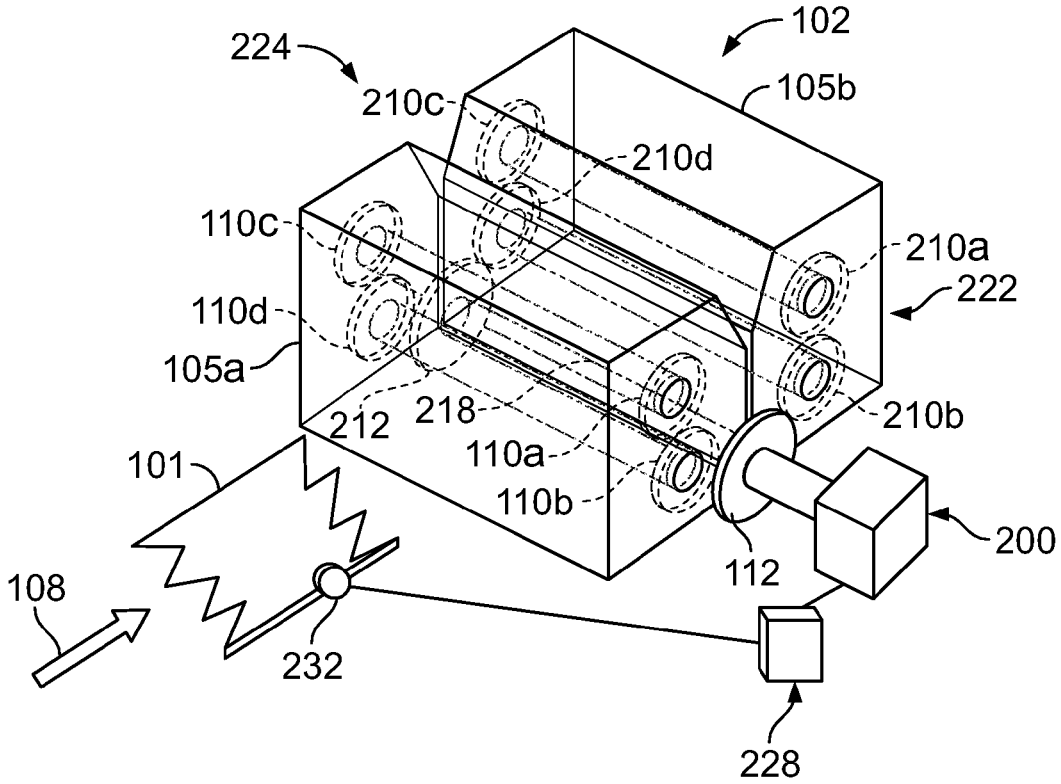

To drive the rotary presses 105*a* and 105*b*, the example rotary press system 102 is provided with a common drive gear 112. In the illustrated example, the common drive gear 112 is shown as being directly engaged to the lower spur gear 110*b* of the first rotary press 105*a* and the lower spur gear 210*b* of the second rotary press 105*b*. The upper spur gears 110*a* and 210*a* may directly engage respective ones of the lower spur gears 110*b* and 210*b*, and the lower spur gears 110*b* and 210*b* may directly engage the common drive gear 112 to form a direct drive configuration. In this configuration, the common drive gear 112 may directly drive the spur gears 110*a*, 210*a*, 110*b* and 210*b* to cause the spur gears 110*a*, 210*a*, 110*b* and 210*b* to rotate about their respective rotational axes to enable the rams 114*a* and 114*b* and the rams 214*a* and 214*b* to work cooperatively to shear, punch, or otherwise cut or penetrate the material 101 as it moves through the rotary press system 102. To rotate the common drive gear 112, the example rotary press system 102 is provided with a rotary actuation member, which in the illustrated example of FIGS. 2A and 2B is implemented using a drive motor 200.

In the illustrated example, the upper spur gears 110*a* and 210*a* may be configured to move the upper rams 114*a* and 214*a* along respective generally circular paths and the lower spur gears 110*b* and 210*b* are configured to move the lower rams 114*b* and 214*b* along respective generally circular paths. In particular, the upper spur gear 110*a*, the lower spur gear 110*b*, and the common drive gear 112 work cooperatively to move the upper ram 114*a* along an upper generally circular path and the lower ram 114*b* along a lower generally circular path in a direction (e.g., a clockwise direction) opposite the direction (e.g. a counter-clockwise direction) of the upper path. Similarly, the upper spur gear 210*a*, the lower spur gear 210*b*, and the common drive gear 112 work cooperatively to move the upper ram 214*a* along an upper generally circular path and the lower ram 214*b* along a lower generally circular path in a direction opposite the direction of the upper path. In some example implementations, the rams 114*a*, 114*b*, 214*a* and 214*b* can be configured to travel along respective generally elliptical paths by using cam-shaped rotary members to implement the gears 110*a*, 110*b*, 210*a* and 210*b* and a direct drive or an indirect drive configuration to drive the cam-shaped rotary members.

In the illustrated example of FIG. 1, the gear ratios between the drive gear 112 and the spur gears 110*b* and 210*b* cause the rams 114*a* and 114*b* and the rams 214*a* and 214*b* to travel along their respective 360-degree paths based on a particular number of 360-degree rotations of the motor 200 and the drive gear 200. However, in other example implementations, the gear ratios between drive member 112 and the spur gears 110*b* and 210*b* can be configured differently to cause the rams 114*a*, 114*b*, 214*a* and 214*b* to complete respective 360-degree cycles while the motor 200 and the drive gear 112 complete fewer or more 360-degree rotations.

Although not shown in FIG. 1, the other end sides of the rotary presses 105*a* and 105*b* include gears that are substantially similar or identical to respective ones of the gears 110*a*, 110*b*, 210*a*, 210*b* and 112. The gears 110*a*, 110*b*, 210*a*, 210*b* and 112, and their respective gears on the other end side of the example rotary press system 102 shown in FIG. 2B, may be implemented using any type of gears or other drive members having any shape and that enable rotation about a rotational axis.

FIG. 2A is an elevated view and FIG. 2B is an isometric view of the example rotary press system 102 of FIG. 1. FIG. 2B shows a first gear assembly side 222 described above in connection with FIG. 1 and a second gear assembly side 224 of the rotary press system 102. The sides 222 and 224 of the rotary press system 102 include substantially similar or identical components arranged or configured in substantially the same way. As shown, the first gear assembly side 222 includes the upper and lower spur gears 110*a* and 110*b* of the rotary press 105*a*, the upper and lower spur gears 210*a* and 210*b* of the rotary press 105*b*, and the common drive gear 112. The second gear assembly side 224 includes upper and lower spur gears 110*c* and 110*d* of the rotary press 105*a*, upper and lower spur gears 210*c* and 210*d* of the rotary press 105*b*, and a common drive gear 212 to drive the gears 110*c*, 110*d*, 210*c* and 210*d*.

In the illustrated example, the common drive gear 112 is directly engaged to the lower spur gears 110*b* and 210*b*, and the common drive gear 212 is directly engaged to the lower spur gears 110*d* and 210*d*. The drive gear 212 is coupled to the drive gear 112 via a shaft 218 (e.g., a driveshaft), and an end of the shaft 218 is coupled to the drive motor 200. The motor 200 may be any suitable motor such as, for example, a stepper motor, a servo motor, a hydraulic motor, etc. To control the speed and acceleration of the motor 200 and, thus, the movement of the rams 114*a*, 114*b*, 214*a* and 214*b* of the rotary press system 102, the rotary press system 102 is provided with a controller 228, which can be implemented using the example processor system 710 of FIG. 7 discussed below. In addition, the rotary press system 102 is provided with an encoder 232 to monitor the speed and/or length of the material 101 passing through the rotary press system 102. The encoder 232 may be implemented using, for example, an optical encoder, a magnetic encoder, etc. In other example implementations, other sensor devices may be used instead of an encoder to monitor the speed and/or length of the material 101.

The motor 200 transmits torque via the shaft 218 to the drive gears 112 and 212. Driving the drive gears 112 and 212 via the shaft 218 allows delivering substantially equal or the same amount of torque to both ends of the upper and lower rams 114*a*, 114*b*, 214*a* and 214*b* of the presses 105*a* and 105*b*. In this manner, the substantially equal or same amount of force applied to each end of the rams 114*a*, 114*b*, 214*a* and 214*b* causes both ends thereof to advance through a generally circular or elliptical path substantially simultaneously with forces uniformly distributed across their length. Maintaining a uniform driving force across the rams substantially reduces or eliminates axial twisting or torsion along the length of the rams 114*a*, 114*b*, 214*a* and 214*b*, which in turn, substantially reduces or eliminates tool wear due to tool misalignments upon impact when axial twisting or torsion occurs. The uniform driving force also enables the presses 105*a* and 105*b* to cut relatively heavy gauge material by maintaining a substantially uniform or equal cutting force across an entire width of a strip material.

In the illustrated example of FIG. 2B, the common drive gears 112 and 212, the lower spur gears 110*b*, 110*d*, 210*b* and 210*d*, and the upper spur gears 110*a*, 110*c*, 210*a* and 210*c* form a direct-drive system. In the direct-drive system, the drive motor 200 directly drives (e.g., without any other interposing mechanism or device such as a transmission or the like) the shaft 218 and the common drive gears 112 and 212. In alternative example implementations, other drive configurations may be used. For example, various drive members may be coupled to each other using any combination of chains, belts, frictional engagement devices, fluid couplings, etc. Of course, one or more of the gears 110*a*, 210*a*, 110*b*, 210*b*, 110*c*, 210*c*, 110*d*, 210*d*, 112 and 212 may be replaced with pulleys, sprockets, or any other suitable drive members. In some example implementations, the drive motor 200 can be coupled directly to the drive gear 112 in a direct-drive configuration with or without an intervening gear box.

In the direct-drive system, the drive gear 112 directly drives the lower spur gears 110*b* and 210*b* to rotate about their rotational axes and the lower spur gears 110*b* and 210*b* then directly drive the upper spur gears 110*a* and 210*a* to rotate about their rotational axes in a counter-rotating direction relative to the lower spur gears 110*b* and 210*b*. The counter-rotation of the spur gears 110*a* and 110*c* relative to the spur gears 110*b* and 110*d* causes the rams 114*a* and 114*b* (shown in FIG. 1) to substantially match the translational direction of the material 101 as the material 101 moves through the rotary press 105*a*. Similarly, the counter-rotation of the spur gears 210*a* and 210*c* relative to the spur gears and 210*b* and 210*d* causes the rams 214*a* and 214*b* to substantially match the translational direction of the material 101 as the material 101 moves through the rotary press 105*b*. In addition, the controller 228 is configured to control the speed and acceleration of the motor 200 so that the rams 114*a* and 114*b* of the rotary press 105*a* and the rams 214*a* and 214*b* of the rotary press 105*b* match the translational speed of the material 101 as the rams 114*a*, 114*b*, 214*a* and 214*b* approach and travel through a cutting position (e.g., a nip position, a shearing position, a punching position, a pressing position, etc.) in the same direction as the direction traveled by the material 101. In this manner, the cutting tool members can shear, punch, or otherwise cut or penetrate the material 101 without interrupting the continuous movement of the material 101 as it travels through the rotary presses 105*a* and 105*b*.

Providing the rotary press system 102 of FIGS. 1, 2A and 2B with the common drive motor 200 and the common drive gears 112 and 212 to drive the rotary presses 105*a* and 105*b* substantially reduces the overall foot print (e.g., floor space area) that would otherwise be required if each of the rotary presses 105*a* and 105*b* were provided with respective drive motors and respective sets of drive gears. Decreasing the foot print or the required floor space area can increase production by increasing the number of production lines that can be installed in a particular area. Additionally, the rotary press system 102 can provide synchronized operation between the rotary presses 105*a* and 105*b*, thereby, requiring less down time or maintenance time to adjust, balance and/or synchronize the presses 105*a* and 105*b* as would otherwise be required by rotary presses having respective drive motors. Thus, when the rotary press system 102 is coupled to subsequent processes such as roll-forming processes, as discussed above, the rotary press system 102 can increase the overall output of the material forming process.

Figure 3:
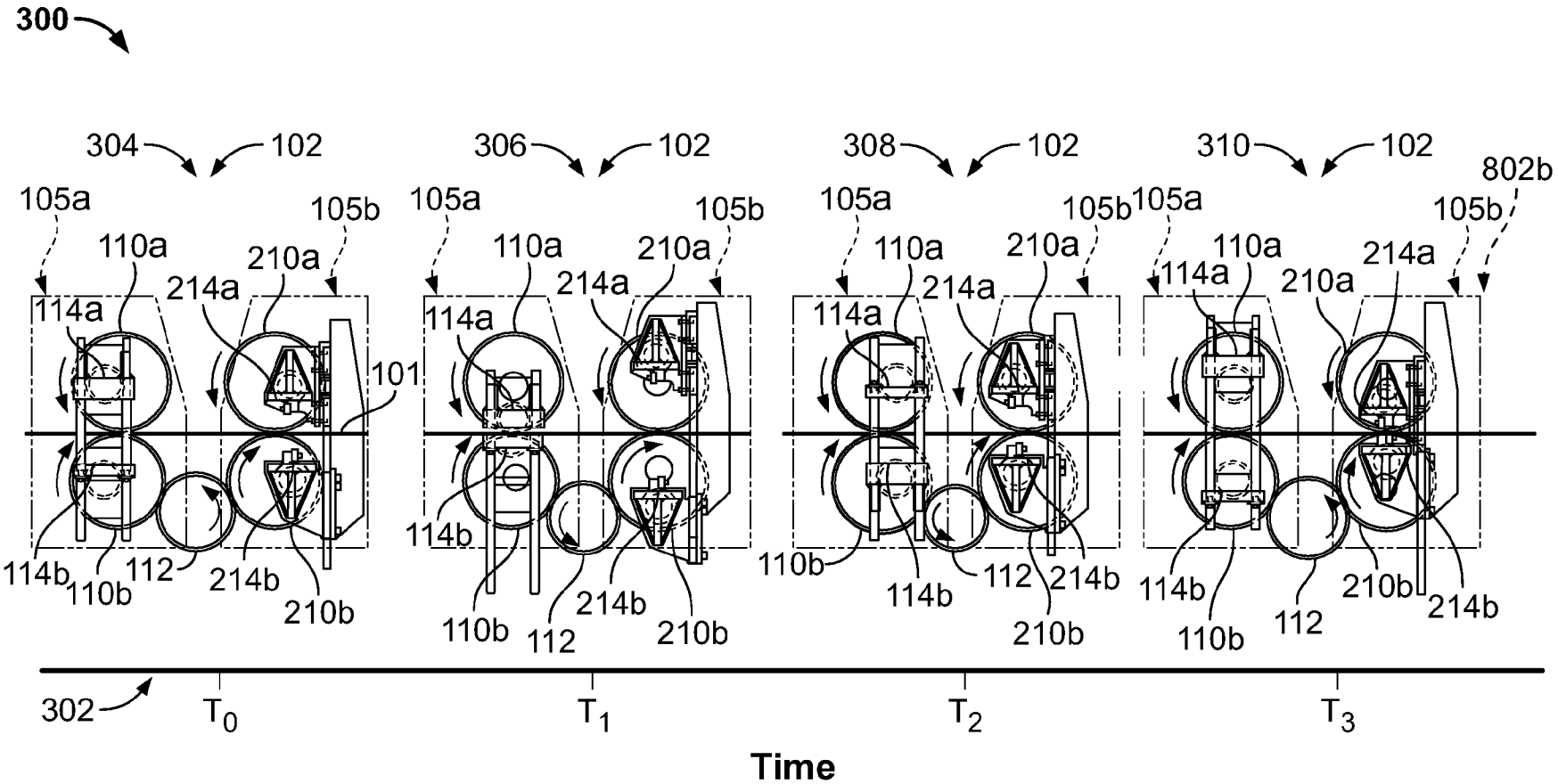
FIG. 3 is a time sequence view depicting the operation of the example rotary press system of FIGS. 1, 2A and 2B.

FIG. 3 is an example time sequence view 300 showing the operation of the example rotary press system 102 of FIGS. 1, 2A and 2B. In particular, the example time sequence 300 shows the time-varying relationship between the common drive gear 112, the spur gears 110*a*, 110*b*, 210*a* and 210*b*, and the rams 114*a*, 114*b*, 214*a* and 214*b* during operation of the rotary press system 102 of FIGS. 1, 2A and 2B. As shown in FIG. 3, the example time sequence 300 includes a time line 302 and shows the rotary presses 105*a* and 105*b* at several times during operation. More specifically, the rotary presses 105*a* and 105*b* are shown in a sequence of rotary press phase positions indicated by a $T_0$ phase position 304, a $T_1$ phase position 306, a $T_2$ phase position 308, and a $T_3$ phase position 310. As the upper spur gears 110*a* and 210*a* rotate in a clock-clockwise direction and the lower spur gears 110*b* and 210*b* rotate in a clockwise direction, the operation of the rotary presses 105*a* and 105*b* progresses through the phases 304, 306, 308 and 310. Although FIG. 3 depicts only the first gear assembly side 222 (FIG. 2B) of the rotary press system 102, both of the sides 222 and 224 of the rotary press system 102 shown in FIG. 2B work cooperatively to enable operation of the rotary presses 105*a* and 105*b* according to the example operational sequence shown in FIG. 3.

Now turning in detail to the operation of the rotary presses 105*a* and 105*b*, the drive motor 200 drives the common drive gear 112 in a counter-clockwise direction. The common drive gear 112, in turn, causes the lower spur gears 110*b* and 210*b* to rotate in a clockwise direction, and each of the gears 110*b* and 210*b* causes a respective one of the upper spur gears 110*a* and 210*a* to rotate in a counter-clockwise direction. As the spur gears 110*a* and 110*b* and 210*a* and 210*b* rotate, the rams

114*a*, 114*b*, 214*a* and 214*b* travel along their respective generally circular or elliptical paths as shown by the phase positions 304, 306, 308 and 310. Also, the rams 114*a* and 114*b* of the rotary press 105*a* are held in substantially vertical alignment relative to each other as they travel along their respective paths and the rams 214*a* and 214*b* of the rotary press 105*b* are similarly held in substantially vertical alignment relative to each other.

The $T_0$ phase position 304 shows the rams 114*a* and 114*b* of the rotary press 105*a* and the rams 214*a* and 214*b* of the rotary press 105*b* at their initial position. In the illustrated example of FIG. 3, the position of the rams 114*a* and 114*b* of the rotary press 105*a* are 180 degrees out of phase with the positions of the rams 214*a* and 214*b* of the rotary press 105*b*. The $T_1$ phase position 306 shows the rams 114*a* and 114*b* of the rotary press 105*a* as they travel through the cutting position (e.g., a pressing position, a nip position, a shearing position, a punching position, etc.). As shown in the $T_1$ phase position 306, when the rams 114*a* and 114*b* of the rotary press 105*a* are in the cutting position, the rams 214*a* and 214*b* of the rotary press 105*b* are in a maximum open position (e.g. the rams 214*a* and 214*b* are the furthest away from one another along their respective circular or elliptical paths). As the rams 114*a* and 114*b* meet to punch, cut, etc., the material 101 at the pressing position, the material 101 may be punched to remove a portion 301 as the material 101 moves through the rotary press 102.

The $T_2$ phase position 308 shows the rams 114*a* and 114*b* of the rotary press 105*a* as they travel away from the cutting position and shows the rams 214*a* and 214*b* of the rotary press 105*b* as they travel toward a cutting position. The $T_3$ phase position 310 shows the rams 214*a* and 214*b* of the rotary press 105*b* as they travel through the cutting position and shows the positions of the rams 114*a* and 114*b* of the rotary press 105*a* as they travel away from their cutting position. The illustrated example shows that when the rams 214*a* and 214*b* of the rotary press 105*b* are in the cutting position, the rams 114*a* and 114*b* of the rotary press 105*a* are in a maximum open position (e.g. the rams 114*a* and 114*b* are the furthest away from one another along their respective circular or elliptical paths).

Although the illustrated example of FIG. 3 shows that the rams 114*a*, 114*b*, 214*a* and 214*b* of the rotary presses 105*a* and 105*b* approach their respective cutting positions in alternating phases, in other example implementations, the rotary presses 105*a* and 105*b* may punch, shear, or otherwise cut or penetrate the material 101 in the same phase (e.g., at substantially the same time). In addition, the rams 114*a* and 114*b* of the rotary press 105*a* and the rams 214*a* and 214*b* of the rotary press 105*b* are not limited to being 180 degrees out of phase. Instead, in alternative example implementations, the rotary presses 105*a* and 105*b* can be out of phase relative to one another by any other amount including, for example, 45 degrees, 90 degrees, etc.

Figure 4:
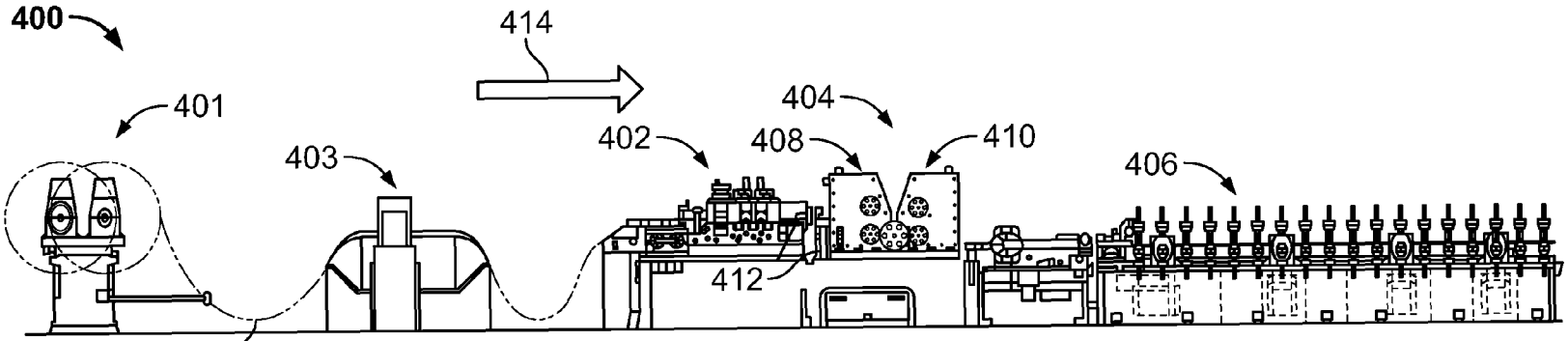
FIG. 4 is an example material forming process that may be configured to use the example rotary press system of FIGS. 1, 2A and 2B.

FIG. 4 is an example material forming process 400 that may be configured to use the example rotary press system 102 of FIGS. 1, 2A and 2B. The example material forming process 400 includes a material stock roll 401, a material feed unit 402, a leveler 403, a rotary press system 404, and a roll-former unit 406. The rotary press system 404 may be implemented using the example rotary press system 102 of FIGS. 1, 2A, 2B and 3. In particular, the rotary press system 404 includes a punching rotary press 408 that may be implemented using the example rotary press 105*a* of FIGS. 1, 2A, 2B and 3, and a shearing rotary press 410 that may be implemented using the example rotary press 105*b* of FIGS. 1, 2A, 2B and 3. The example material forming process 400 may be used to process a substantially continuously moving material such as, for example, the moving material 101 of FIG. 1.

The example material forming process 400 may be used in combination with other processes that handle or process a material. For example, the example material forming process 400 may be implemented within an assembly line to perform a subset of operations of the assembly line. Alternatively, the example material forming process 400 may be a standalone process that forms a self-contained assembly line performing substantially all of the operations of the assembly line. Although, the example rotary presses 105*a* and 105*b* are generally shown in the process configuration of the example material forming process 400, any other configuration using any other process operations in combination with the example rotary presses 105*a* and 105*b* may be implemented instead.

Figure 5B:
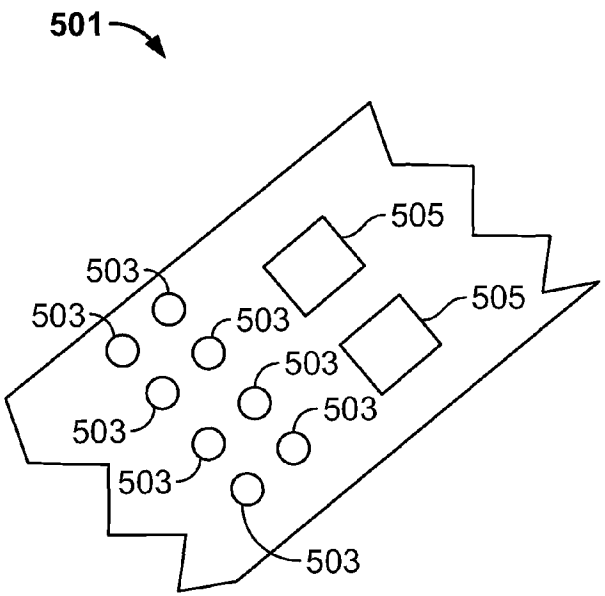
FIGS. 5A and 5B are isometric views of example products that may be produced by the example material forming process of FIG. 4.
Figure 5A:
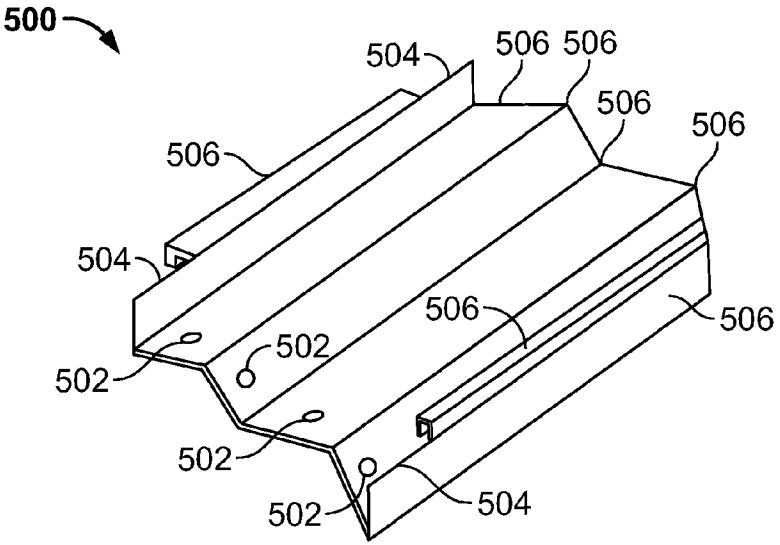

As the material 101 moves through the example material forming process 400 along a material translation path 412 in a direction generally indicated by arrow 414, the example material forming process 400 may be configured to alter the shape, form, and/or other aesthetic or physical characteristics of the moving material 101. For example, the example material forming process 400 may be configured to punch, shear, and roll-form the moving material 101 using the punching rotary press 408, the shearing rotary press 410 and the roll-former unit 406 to produce, for example, an example seam panel 500 of FIG. 5A.

The example seam panel 500 is made using a flat sheet (planar) or strip material (i.e., the moving material 101) that is fed by the material feed unit 402 toward the rotary press system 404. The example seam panel portion 500 of FIG. 5A includes a plurality of cutout portions 502, a sheared edge 504, and a plurality of edges 506. Although the example material forming process 400 is configured to produce the example seam panel 500 as described below, the example material forming process 400 may be configured to form other items having other configurations such as, for example, different folds, different cutout portions, different material segment lengths, etc.

In the illustrated example of FIG. 4, the moving material 101 is fed, propelled, or conveyed toward the punching rotary press 408 by the material feed unit 402 along the material translation path 412, and the punching rotary press 408 may be configured to punch the moving material 101 to form two cutout portions 502 of the example seam panel 500. For example, the punching rotary press 408 may be provided with cutting tools such as, for example, a punch that is mechanically coupled to an upper ram (e.g., the upper ram 114*a* of FIG. 1) and a die that is mechanically coupled to a lower ram (e.g., the lower ram 114*b* of FIG. 1) that punch cutout portions (e.g., holes) into the moving material 101. The cutout portions 502 of the example seam panel 500 are shown as a plurality of circular holes that are punched in parallel. However, the punching rotary press 408 may be configured to create any other type of cutouts at any position on the moving material 101. In some example implementations, the positions of cutout portions 502 may be set by selecting different punch and die sets. Example punch and die set configurations may include punches and dies that punch cutout portions in various configurations including, for example, a serial configuration, a parallel configuration, a staggered configuration, etc. The material feed unit 402 then feeds, propels, or conveys the moving material 101 toward the shearing rotary press 410.

In the illustrated example, the shearing rotary press 410 is configured to shear (e.g., cut, slice, etc.) the moving material 101 to form the sheared edges 504 to create material sections of any desired length to form a plurality of material segments of the moving material 101 that travel along the material translation path 412 in a serial manner. The shearing rotary press 410 may be configured to shear the moving material 101 by, for example, using a cut-off blade and cut-off ram mechanically coupled to the upper ram 114*a* (FIGS. 1 and 2B) and the lower ram 114*b* (FIGS. 1 and 2B), respectively. In the illustrated example, the material segments are moved from the shearing rotary press 410 to the roll-former unit 406.

The roll-former unit 406 includes a plurality roll-forming passes that roll-form the material segments received from the shearing rotary press 410. In the illustrated example, the roll-former unit 406 is configured to obtain the material segments from the shearing rotary press 410 and progressively roll-form each material segment to form the plurality of edges 506 of the example seam panel 500 as the material segments are passed through a series of roll-forming passes. In general, the roll-former unit 406 may be configured to fold the material segments by creating any desired edge or edges using the roll-forming passes. In some example implementations, the material feed unit 402 and the roll-former unit 406 may be configured to move the material 101 at substantially the same speed.

Although the example rotary press systems 102 and 404 are described as having a punching press and a shearing press, in other example implementations, the rotary press systems 102 and 404 may be provided with two punching rotary presses. For example, in the illustrated example of FIG. 4, the rotary press 408 may be configured to punch circular holes and the rotary press 410 that may be configured to punch square holes to produce, for example, an example panel 501 of FIG. 5B. To produce the example panel 501, pre-sheared panels may be fed, propelled or conveyed to the rotary press system 404 and a controller (e.g., the controller 228 of FIG. 2) may be configured to rotate the rams of the first rotary press 408 (and, thus, the rams of the second rotary press 410) at a relatively fast speed relative to the speed of the panel 501 to punch rows of circular holes 503 in the example 501 before the panel 501 reaches the second rotary press 410. The controller 228 can then pause rotation of the presses 408 and 410 as the panel 501 continues to move through the rotary press system 404. When the panel 501 reaches a position at which the square holes 505 are to be punched, the controller 228 can rotate the rams of the second rotary press 410 (and, thus, the rams of the first rotary press 408) to punch the square holes 505.

Figure 6:
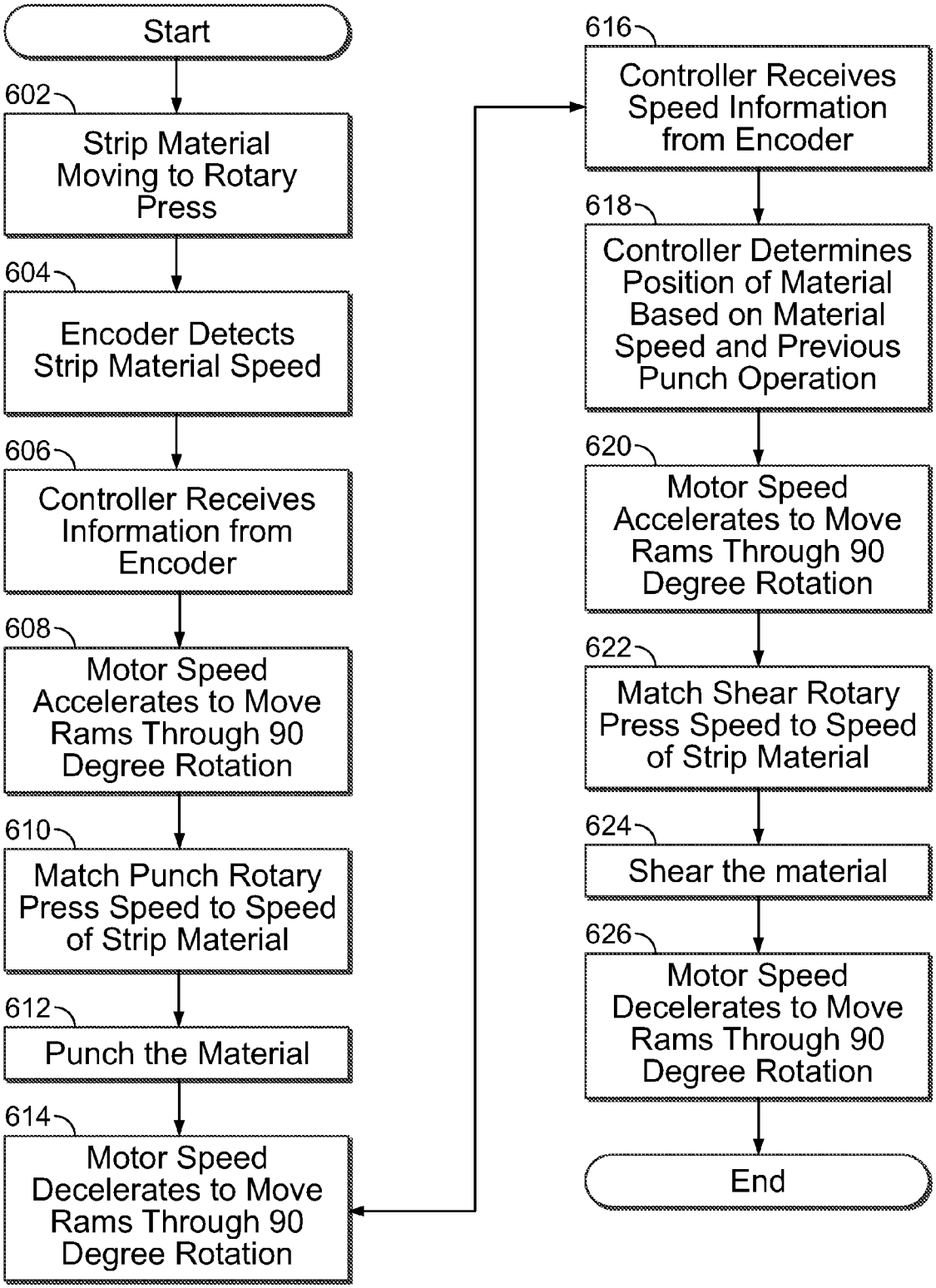
FIG. 6 is a flow chart diagram of an example method that may be used to control the example rotary press system of FIGS. 1, 2A, 2B, 3 and 4.

FIG. 6 is a flow chart of an example method that may be used to implement the rotary press system 102 of FIGS. 1, 2A, 2B and 3. In some example implementations, the example method of FIG. 6 may be implemented using machine readable instructions comprising a program for execution by a processor (e.g., the processor 712 shown in the example system 710 of FIG. 7) such as, for example, a processor of the controller 228 (FIG. 2B). The program may be embodied in software stored on a tangible medium such as a CD-ROM, a floppy disk, a hard drive, a digital versatile disk (DVD), or memory associated with the processor 712 and/or embodied in firmware and/or dedicated hardware in a well-known manner. Further, although the example program is described with reference to the flow chart illustrated in FIG. 6, persons of ordinary skill in the art will readily appreciate that many other methods of implementing the example rotary press system 102 may alternatively be used. For example, the order of execution of the blocks may be changed, and/or some of the blocks described may be changed, eliminated, or combined.

Turning in detail to FIG. 6, as the material 101 moves to the rotary press system 102 (block 602), the encoder 232 (FIG. 2) detects the speed of the material 101 (block 604). The controller 228 then receives the speed information from the encoder 232 (block 606) and causes the speed of the motor 200 to accelerate to move the rams 114*a* and 114*b* and the rams 214*a* and 214*b* through a 90 degree phase (block 608) of their respective generally circular or elliptical paths. For example, as shown in FIG. 3, the controller 228 causes the motor 200 to accelerate to move the rams 114*a* and 114*b* 90 degrees from a position shown in the phase position $T_0$ 304 to a cutting position shown in the phase $T_1$ 306. By accelerating the motor 200, the controller 228 causes the rams 114*a* and 114*b* to match the speed of the material 101 (block 610) as the rams 114*a* and 114*b* approach the cutting position. The rams 114*a* and 114*b* then punch the material 101 (block 612) while the material 101 continues to move. As shown in FIG. 3, the rams 114*a* and 114*b* move toward their cutting position, while the rams 214*a* and 214*b* move away from their cutting position After the rotary press 105*a* punches the material 101, the rams 114*a* and 114*b* continue to move through and away from the cutting position of the $T_1$ phase 306 (FIG. 3), and the controller 228 causes the motor 200 to decelerate (block 614). As the motor decelerates at block 614, the rams 114*a* and 114*b* of the punching rotary press 105*a* and the rams 214*a* and 214*b* of the shearing rotary press 105*b* synchronously decelerate through a subsequent 90 degrees to their respective positions of the $T_2$ phase 308.

As the material 101 continues to move through the rotary press system 102, the controller 228 receives material speed information from the encoder 232 (block 616). The controller 228 then determines the position of the material 101 based on the speed information and a recorded time of the punch operation performed at block 612 (block 618). In some example implementations, the controller 228 may be configured to cause the motor 200 to pause after the motor 200 decelerates as the rams 114*a* and 114*b* continue to move away from the cutting position of the $T_1$ phase 306 (FIG. 3) and before the rams 214*a* and 214*b* accelerate to move toward the cutting position shown in the $T_3$ phase position 310 (FIG. 3). The pause in motor rotation allows the material 101 to continue to move through the press system 102 after the punching operation and prior to the shearing operation discussed below. This pause in rotation causes the material 101 to continue to move through the press system prior to the shearing operation, thereby resulting in a longer product.

To shear the material 101 at a shearing position, the controller 228 causes the motor 200 to accelerate to cause the rams 114*a* and 114*b* and the rams 214*a* and 214*b* to accelerate through a 90 degree phase (block 620) of their respective generally circular or elliptical paths. As the motor 200 accelerates through a 90 degree phase, the rams 214*a* and 214*b* move from the $T_2$ phase position 308 toward a cutting position shown in the $T_3$ phase position 310. In addition, the rams 114*a* and 114*b* of the rotary press 105*a* substantially simultaneously move further away from their cutting position to a maximum open position shown in the $T_3$ phase 310.

As the rams 214*a* and 214*b* of the shearing press 105*b* reach their cutting position, the controller 228 causes the speed of the rams 214*a* and 214*b* to match the speed of the material 101 (block 622), and the shearing rams 214*a* and 214*b* shear the material 101 (block 624). The controller 228 then causes the rams 114*a*, 114*b*, 214*a* and 214*b* to decelerate as they move to their subsequent positions (block 626) shown in the $T_0$ phase 304 of FIG. 3. The rotary press system 102 can then continue to punch and shear subsequent material as described above or the example process of FIG. 6 can end. As discussed above, in some example implementations, the controller 228 may configured to cause the motor 200 to pause after the motor 200 decelerates while the rams 214*a* and 214*b* move away from the cutting position of the $T_3$ phase 310 (FIG. 3).

In the example process described above, the controller 228 causes the rams 114*a*, 114*b*, 214*a* and 214*b* to accelerate and decelerate through 90 degree phases. However, in other example implementations, the controller 228 can cause the rams 114*a*, 114*b*, 214*a* and 214*b* to accelerate and decelerate through different angular rotations such as, for example, a 45 degree rotation, a 180 degree rotation, etc. For example, the controller 228 may cause the rams 114*a*, 114*b*, 214*a* and 214*b* to accelerate through a 45 degree rotation to match the speed of the material 101 and then to travel at the speed of the material 101 through the next 45 degrees until the rams 114*a*, 114*b*, 214*a* and 214*b* strike the material 101. In yet other example implementations, the controller 228 may be configured to cause the motor 200 to accelerate, decelerate, and/or pause using different patterns to achieve different punching and/or shearing configurations.

Figure 7:
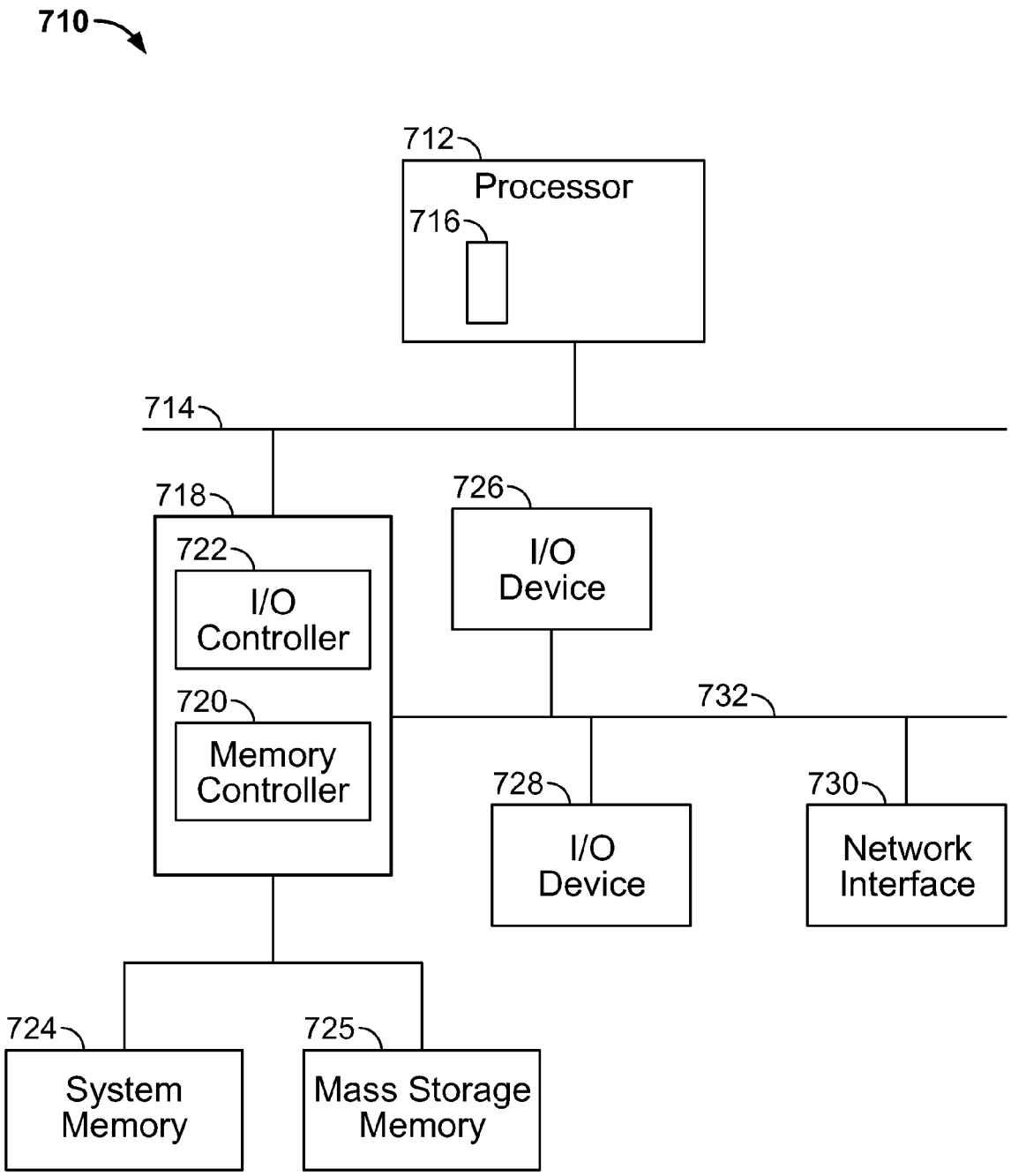
FIG. 7 is a block diagram of an example processor system that may be used to implement the example methods and systems described herein.

FIG. 7 is a block diagram of an example processor system 710 that may be used to implement the methods and systems described herein. As shown in FIG. 7, the processor system 710 includes a processor 712 that is coupled to an interconnection bus 714. The processor 712 includes a register set or register space 716, which is depicted in FIG. 7 as being entirely on-chip, but which could alternatively be located entirely or partially off-chip and directly coupled to the processor 712 via dedicated electrical connections and/or via the interconnection bus 714. The processor 712 may be any suitable processor, processing unit or microprocessor. Although not shown in FIG. 7, the system 710 may be a multi-processor system and, thus, may include one or more additional processors that are identical or similar to the processor 712 and that are communicatively coupled to the interconnection bus 714.

The processor 712 of FIG. 7 is coupled to a chipset 718, which includes a memory controller 720 and an input/output (I/O) controller 722. As is well known, a chipset typically provides I/O and memory management functions as well as a plurality of general purpose and/or special purpose registers, timers, etc. that are accessible or used by one or more processors coupled to the chipset 718. The memory controller 720 performs functions that enable the processor 712 (or processors if there are multiple processors) to access a system memory 724 and a mass storage memory 725.

The system memory 724 may include any desired type of volatile and/or non-volatile memory such as, for example, static random access memory (SRAM), dynamic random access memory (DRAM), flash memory, read-only memory (ROM), etc. The mass storage memory 725 may include any desired type of mass storage device including hard disk drives, optical drives, tape storage devices, etc.

The I/O controller 722 performs functions that enable the processor 712 to communicate with peripheral input/output (I/O) devices 726 and 728 and a network interface 730 via an I/O bus 732. The I/O devices 726 and 728 may be any desired type of I/O device such as, for example, a keyboard, a video display or monitor, a mouse, etc. The network interface 730 may be, for example, an Ethernet device, an asynchronous transfer mode (ATM) device, an 802.11 device, a DSL modem, a cable modem, a cellular modem, etc. that enables the processor system 710 to communicate with another processor system.

While the memory controller 720 and the I/O controller 722 are depicted in FIG. 7 as separate functional blocks within the chipset 718, the functions performed by these blocks may be integrated within a single semiconductor circuit or may be implemented using two or more separate integrated circuits.

Figure 8:
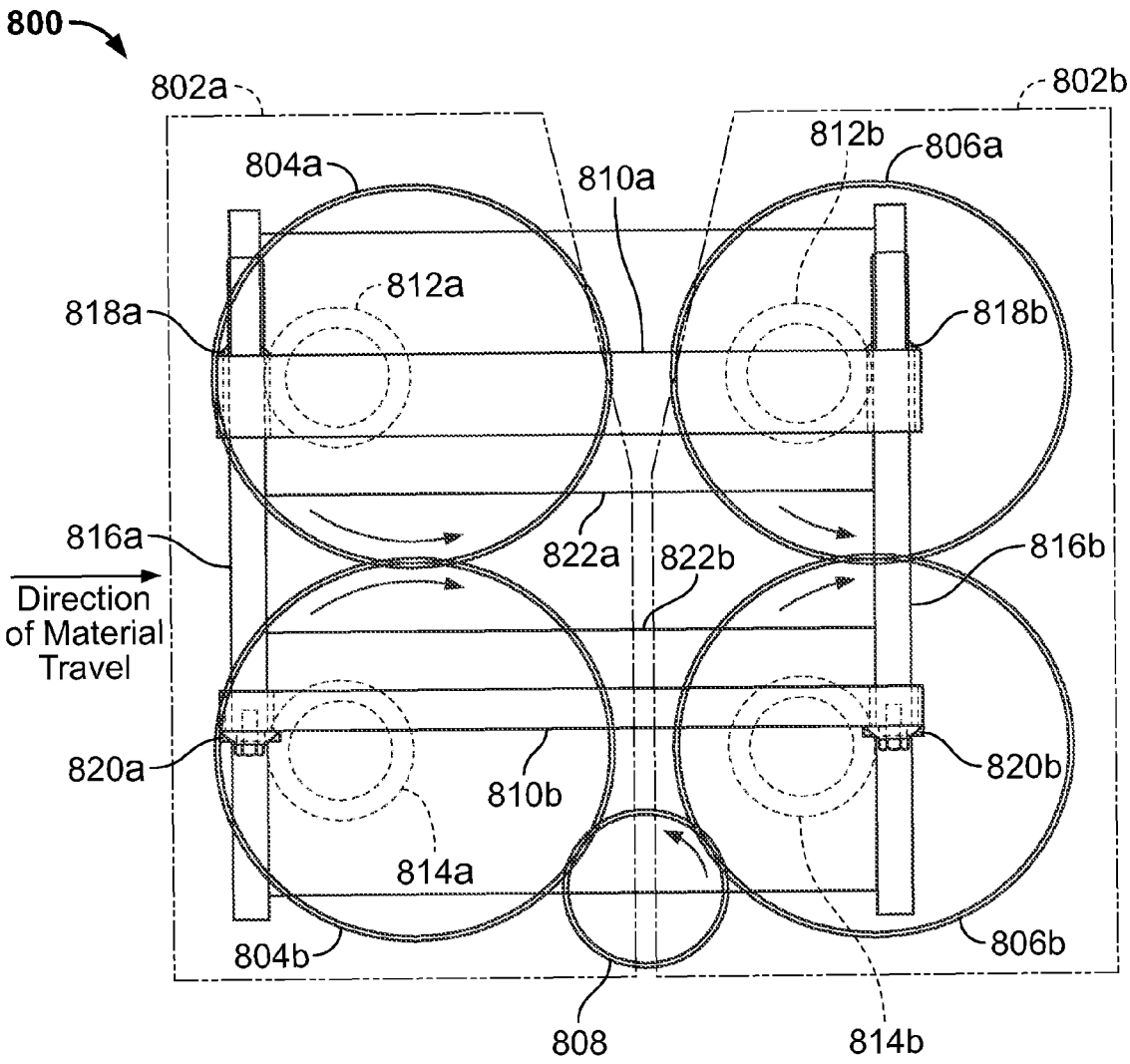
FIG. 8 illustrates another example rotary press system described herein.

FIG. 8 illustrates another example rotary press system 800 that may be used to form patterns covering relatively large areas in strip material such as, for example, the strip material 101. The example rotary press system 800 includes a first rotary press 802*a* adjacent a second rotary press 802*b*. Those components of the rotary press system 800 that are substantially similar or identical to the components of the rotary press system 102 described above and that have functions substantially similar or identical to the functions of those components will not be described in detail again below. Instead, the interested reader is referred to the above corresponding descriptions. For example, the first rotary press 802*a* includes upper and lower spur gears 804*a* and 804*b*, which are substantially similar or identical to spur gears 110*a* and 110*b* of the first rotary press 105*a* (FIG. 1). In addition, the second rotary press 802*b* includes upper and lower spur gears 806*a* and 806*b* that are substantially similar or identical to the spur gears 210*a* and 210*b* of the second rotary press 105*b* (FIG. 1). Furthermore, a common drive gear 808 used to drive the lower spur gears 804*b* and 806*b* is substantially similar or identical to the common drive gear 112 of the rotary press system 102 (FIG. 1). Additionally, although not shown, the rotary press system 800 includes components substantially similar or identical to the components 110*c*, 110*d*, 210*c*, 210*d*, 212, 218, 224, 232, 228, and 200 of the rotary press system 102.

The example rotary press system 800 includes a first punching means or upper ram 810*a* and a second punching means or lower ram 810*b*. The upper ram 810*a* is rotatably coupled to the upper spur gears 804*a* and 806*a* via hubs or crank pins 812*a* and 812*b*, and the lower ram 810*b* is rotatably coupled to the lower spur gears 804*b* and 806*b* via hubs or crank pins 814*a* and 814*b*. Linear guides 816*a* and 816*b* interconnect the upper and lower rams 810*a* and 810*b*. The linear guides 816*a* and 816*b* are slidably coupled to the upper ram 810*a* via linear bearings 818*a-b* and are coupled or fixed to the lower ram 810*b* via couplings 820*a-b*. The linear guides 816*a* and 816*b* ensure that the upper ram 810*a* and the lower ram 810*b* remain in alignment with each other so that a pressing face 822*a* of the upper ram 810*a* and a pressing face 822*b* of the lower ram 810*b* remain substantially parallel to one another as the upper spur gears 804*a* and 806*a* and lower spur gears 804*b* and 806*b* rotate about their respective rotational axes. The linear bearings 818*a-b* may be implemented using any type of bearing that enables linear translation of the rams 810*a-b* along the linear guides 816*a* and 816*b*.

The rams 810*a* and 810*b* may be mechanically coupled to material penetration or cutting devices (i.e., cutting tool members) such as, for example, conventional cutting tools (i.e., punch and die sets, cut-off blade and cut-off ram sets) or any other suitable types of cutting tools. Additionally, the rams 810*a* and 810*b* are configured to provide sufficient structural strength to maintain their structural integrity while impacting (e.g., cutting) a material such as, for example, the material 101, as it moves (e.g., continuously) through the rotary presses 802*a* and 802*b*.

Similar to the rotary press system 102, the example rotary press system 800 is driven via the common drive gear 808. In the illustrated example, the common drive gear 808 is shown as directly engaging the lower spur gear 804*b* of the first rotary press 802*a* and the lower spur gear 806*b* of the second rotary press 802*b* to form a direct drive configuration. In turn, the upper spur gears 804*a* and 806*a* directly engage respective ones of the lower spur gears 804*b* and 806*b*. In this configuration, the common drive gear 808 may directly drive the spur gears 804*a*, 804*b*, 806*a*, and 806*b* to cause the spur gears 804*a*, 804*b*, 806*a*, and 806*b* to rotate about their respective rotational axes to enable the rams 810*a* and 810*b* to work cooperatively to punch, notch, cut, or otherwise penetrate a material as it moves through the rotary press system 800. To rotate the common drive gear 808, the example rotary press system 800 is provided with a rotary actuation member, which is implemented using a drive motor such as, for example, the drive motor 200 of FIG. 2B. In some example implementations, the drive motor can be coupled directly to the common drive gear 808 in a direct-drive configuration with or without an intervening gear box.

In the illustrated example, the rotation of the upper spur gears 804*a* and 806*a* causes the upper ram 810*a* to move along a respective generally circular path and rotation of the lower spur gears 804*b* and 806*b* causes the lower ram 810*b* to move along a respective generally circular path. In particular, the common drive gear 808 causes the lower spur gears 804*b* and 806*b* to rotate in a first direction (e.g., a clockwise direction). In turn, the lower spur gears 804*b* and 806*b* cause the upper spur gears 804*a* and 806*a* to rotate in a second direction (e.g., a counter-clockwise direction) opposite the first direction (e.g., a clockwise direction) of the lower spur gears 804*b* and 806*b*.

In contrast to the rotary press system 102 of FIG. 1, the example rotary presses 802*a* and 802*b* operate in phase relative to each other. In other words, the crank pin 812*a* is at the same rotational phase position as the crank pin 812*b* and the crank pin 814*a* is at the same rotational phase position as the crank pin 814*b*. That is, the crank pins 812*a* and 812*b* are in phase relative to each other and travel simultaneously along the same rotational phase positions while the crank pins 814*a* and 814*b* are in phase relative to each other and travel simultaneously along the same rotational phase positions. In this manner, the counter-rotation of the upper spur gears 804*a* and 806*a* relative to the lower spur gears 804*b* and 806*b* causes the upper and lower rams 810*a* and 810*b* to synchronously rotate such that the pressing faces 822*a* and 822*b* are substantially parallel and aligned relative to each other as the gears 804*a-b* and 806*a-b* rotate to drive the rams 810*a* and 810*b* to a pressing position, in which the rams 810*a* and 810*b* are located at a position on their respective generally circular paths so that the distance between the cutting tool members of the rams 810*a* and 810*b* is at a minimum. When approaching and rotating through the pressing position, the rotational speed of the gears 804*a*, 806*a*, 804*b*, and 806*b* can be controlled so that the speed of the rams 810*a* and 810*b* (and the cutting tool members) match the translational speed of the surfaces of the material as it moves through the rotary presses 802*a* and 802*b*. In this manner, the speed and horizontal translation components of the rams 810*a* and 810*b* enable the cutting tool members to punch, cut, nip, penetrate, or otherwise process the material without interrupting the continuous movement of the material through the rotary press system 800.

As the pressing faces 822*a* and 822*b* travel in opposing directions along respective generally circular paths, the cutting tool members (not shown) work cooperatively to punch, or otherwise cut or penetrate the material (e.g., the material 101) as it moves through the rotary press system 800. As described above, a cutting tool member (not shown) may be mechanically coupled to the pressing face 822*a* and a complementary cutting tool member (not shown) may be mechanically coupled to the pressing face 822*b*. As the pressing faces 822*a* and 822*b* travel along their respective generally circular paths, the faces of the cutting tool members are held substantially parallel and/or aligned relative to each other.

Although not shown in FIG. 8, the rotary presses 802*a* and 802*b* have other end sides that include upper and lower spur gears that are substantially similar or identical to respective ones of the gears 804*a*, 804*b*, 806*a*, 806*b*, and 808. The gears 804*a*, 804*b*, 806*a*, 806*b*, and 808, and their respective gears on the other end side of the example rotary press system 800 shown in FIG. 8, may be implemented using any type of gears or other drive members having any suitable shape and that enable rotation about respective rotational axes.

A driving means for commonly driving the rams 810*a* and 810*b* includes a shaft (similar or identical to the shaft 218 shown in FIG. 2B) having the common drive gear 808 coupled to a proximate shaft end proximate a drive motor (e.g., the motor 200 of FIG. 2B) and a second common drive gear (similar or identical to the second common gear 212 of FIG. 2B) coupled to a distal shaft end. In this manner, the motor 200 can rotate the shaft (not shown) to transfer rotational power to the common drive gear 808 engaging the rotary members 804*b* and 806*b* and the other common drive gear (not shown) at the distal end of the shaft and engaging distal end rotary members corresponding to the rotary members 804*b* and 806*b*. In turn, the lower rotary members on the other end of the presses 802*a* and 802*b* that correspond to the lower rotary members 804*b* and 806*b* engage upper rotary members corresponding to the upper rotary members 804*a* and 806*a*.

Figure 9:
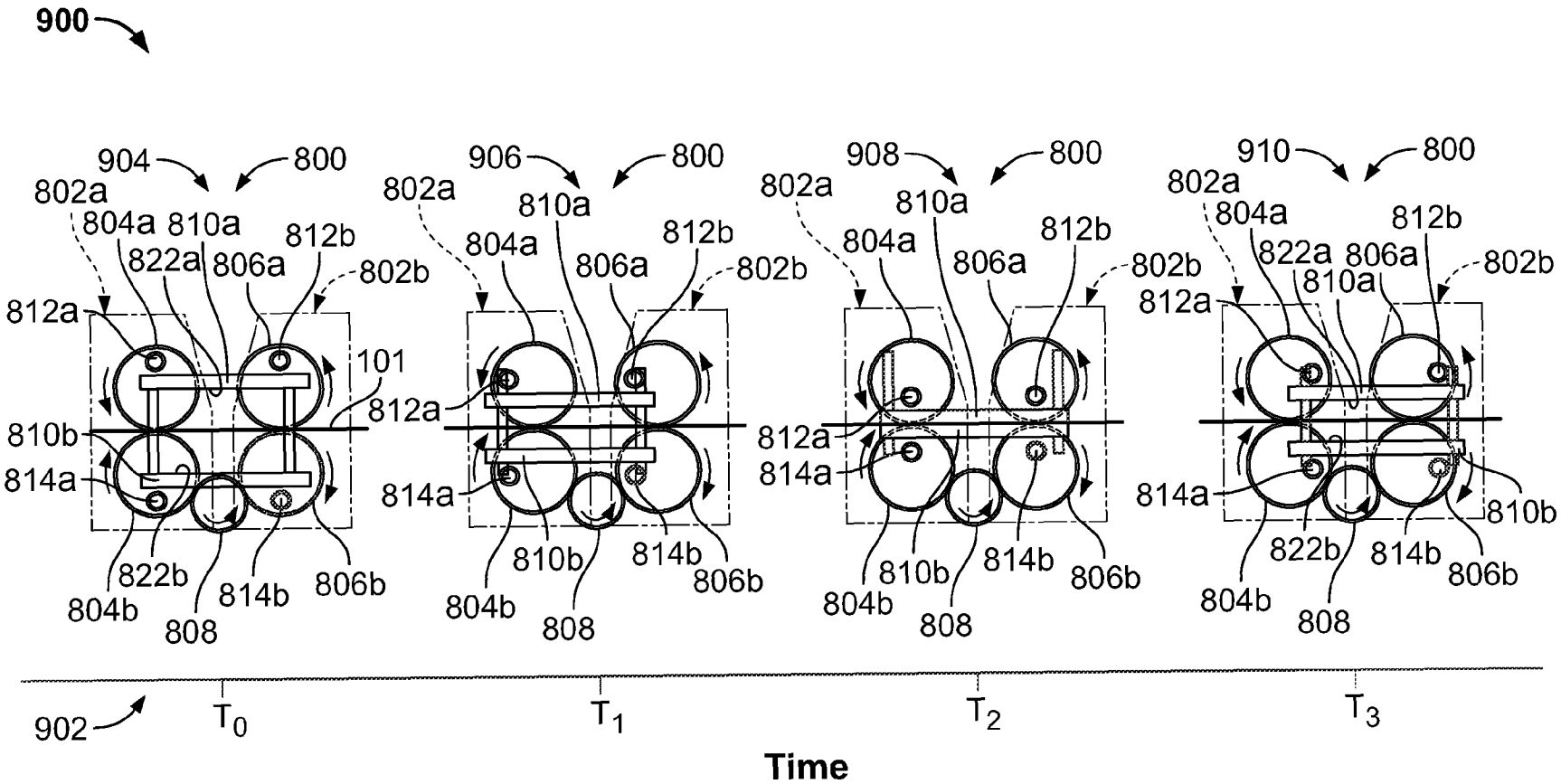
FIG. 9 is a time sequence view depicting the operation of the example rotary press system of FIG. 8.
Figure 10:
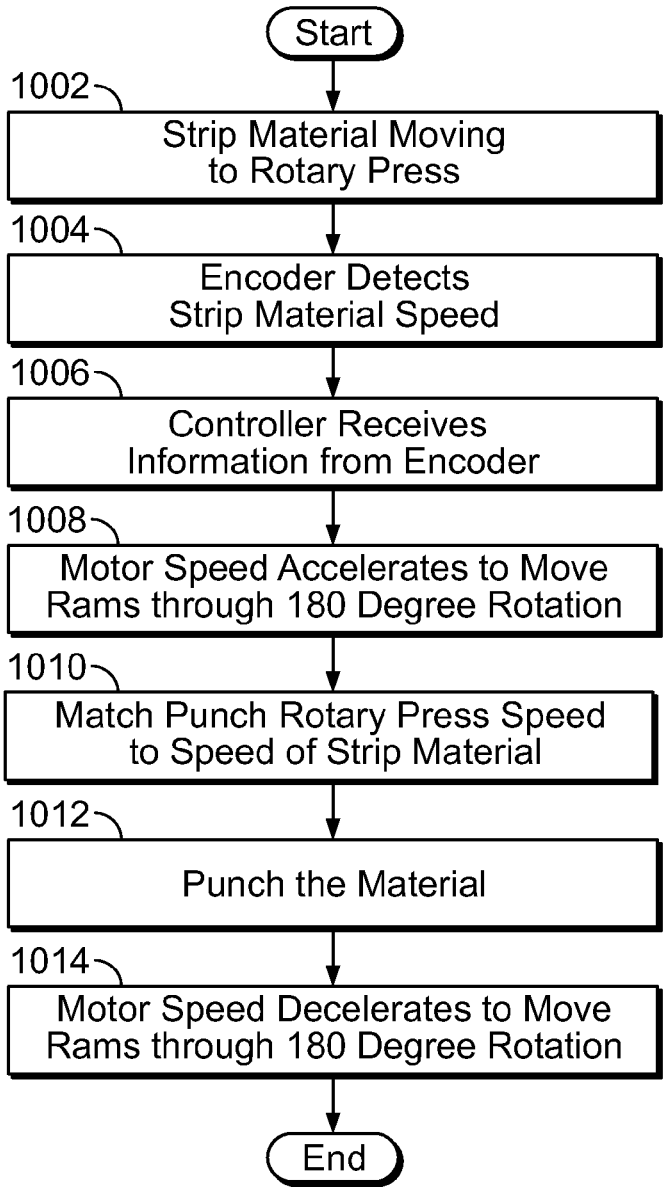
FIG. 10 is a flow chart diagram of an example method that may be used to control the example rotary press system of FIG. 8.

FIG. 9 is an example time sequence view 900 showing the operation of the example rotary press system 800 of FIG. 8. In particular, the example time sequence 900 shows the time-varying relationship between the common drive gear 808, the spur gears 804*a*, 804*b*, 806*a*, and 806*b*, and the rams 810*a* and 810*b* during operation of the rotary press system 800 of FIG. 8. As shown in FIG. 9, the example time sequence 900 includes a time line 902 and shows the rotary presses 802*a* and 802*b* at several times during operation. More specifically, the rotary presses 802*a* and 802*b* are shown in a sequence of rotary press phase positions indicated by a $T_0$ phase position 904, a $T_1$ phase position 906, a $T_2$ phase position 908, and a $T_3$ phase position 910. As the upper spur gears 804*a* and 806*a* rotate in a counter-clockwise direction and the lower spur gears 804*b* and 806*b* rotate in a clockwise direction, the operation of the rotary presses 802*a* and 802*b* progresses through the phases 904, 906, 908, and 910. Although FIG. 9 depicts only a first gear assembly side of the rotary press system 800, a second side of the rotary press system 800 works cooperatively with the first side shown to enable operation of the rotary presses 802*a* and 802*b* according to the example operational sequence shown in FIG. 9.

Now turning in detail to the operation of the rotary presses 802*a* and 802*b*, a drive motor (e.g., the drive motor 200 of FIG. 2A) drives the common drive gear 808 in a counter-clockwise direction. The common drive gear 808, in turn, causes the lower spur gears 804*b* and 806*b* to rotate in a clockwise direction, and each of the gears 804*b* and 806*b* causes a respective one of the upper spur gears 804*a* and 806*a* to rotate in a counter-clockwise direction. As the spur gears 804*a* and 804*b* and 806*a* and 806*b* rotate, the rams 810*a* and 810*b* travel along their respective generally circular or elliptical paths as shown by the phase positions 904, 906, 908, and 910. Also, the rams 810*a* and 810*b* are held in substantially vertical alignment relative to each other as they travel along their respective paths.

In the illustrated example, the rotary press system 800 completes a cycle with a 360-degree rotation of the upper and lower spur gears 804*a-b* and 806*a-b*. The $T_0$ phase position 904 shows the rams 810*a* and 810*b* at their initial position or a maximum open position (e.g., the rams 810*a* and 810*b* are the furthest away from one another along their respective circular or elliptical paths). The $T_1$ phase position 906 shows the rams 810*a* and 810*b* as they travel toward the cutting position.

The example rotary presses 802*a* and 802*b* are in phase relative to each other. The crank pins 812*a* and 812*b* are at the same phase or angular position relative to each other and travel simultaneously along the same rotational phase positions, while the crank pins 814*a* and 814*b* are at the same phase or angular position and travel simultaneously along the same rotational phase positions. As described in greater detail below, the rams 810*a* and 810*b* can accelerate or decelerate to match the speed of the material 101 traveling through the press system 800 as the rams 810*a* and 810*b* approach the cutting position shown in the $T_2$ phase position 908. The $T_2$ phase position 908 shows the rams 810*a* and 810*b* as they travel through the cutting position (e.g., a pressing position, a nip position, a shearing position, a punching position, etc.). As the rams 810*a* and 810*b* meet to punch, cut, etc. the material 101, the rams 810*a* and 810*b* match the speed of the material 101 at the pressing position shown in the $T_2$ phase position 908. At the pressing position, the material 101 is punched to remove a portion of the material 101 as it moves through the rotary presses 802*a* and 802*b*.

The $T_3$ phase position 910 shows the rams 810*a* and 810*b* of the rotary press system 800 as they travel away from the cutting position shown in the $T_2$ phase position. In the illustrated example, the press system completes a 360-degree cycle as the position of the rams 810*a* and 810*b* return to the $T_0$ phase position 904.

The example rotary press 800 is implemented using a drive system and a control system similar to the drive and control systems described in connection with the rotary press system 102. For example, the example rotary press system 800 may be implemented using machine readable instructions comprising a program for execution by a processor (e.g., the processor 712 shown in the example system 710 of FIG. 7) such as, for example, a processor of a controller (e.g., the controller 228 of FIG. 2B). The program may be embodied in software stored on a tangible medium such as a CD-ROM, a floppy disk, a hard drive, a digital versatile disk (DVD), or memory associated with a processor (e.g., the processor 712 of FIG. 7) and/or embodied in firmware and/or dedicated hardware in a well-known manner.

For example, as a material (e.g., the material 101) moves toward the rotary press system 800 (block 1002), an encoder (e.g., the encoder 232 of FIG. 2B) detects the speed of the material 101 (block 1004). A controller (e.g., the controller 228 of FIG. 2B) receives the speed information from the encoder 232 (block 1006) and causes the speed of a motor (e.g., the motor 200 of FIG. 2B) to accelerate to move the rams 810*a* and 810*b* through a 180-degree phase rotation (block 1008) of their respective generally circular paths. For example, the controller 228 causes the motor 200 to accelerate to move the rams 810*a* and 810*b* through a 180-degree phase rotation from a position shown in the $T_0$ phase position 904 (FIG. 9) to the pressing position shown in the $T_2$ phase position 908 (block 1008). By accelerating the motor 200, the controller 228 causes the speed of the rams 810*a* and 810*b* to match the speed of the material 101 (block 1010) as the rams 810*a* and 810*b* approach the pressing position. The rams 810*a* and 810*b* then punch the material 101 (block 1012) while the material 101 continues to move. The rams 810*a* and 810*b* continue to move through and away from the cutting position of the $T_3$ phase position 910. The controller 228 causes the motor to decelerate as the rams 810*a* and 810*b* move through another 180-degree phase from the pressing position in the $T_2$ phase position 908 to a non-pressing position in the $T_0$ phase position 904 (block 1014). The rotary press system 800 can continue to process subsequent material as described above or the example process can end. In some example implementations, the controller 228 may be configured to cause the motor 200 to pause after the motor 200 decelerates while the rams 810*a* and 810*b* move away from the pressing position to control the distance between punches formed in the material 101.

In the example process described above, the controller 228 can cause the rams 810*a* and 810*b* to accelerate and decelerate through different angular rotations such as, for example, a 45-degree rotation, a 180-degree rotation, etc. For example, the controller 228 may cause the rams 810*a* and 810*b* to accelerate through a 45-degree rotation to match the speed of the material 101 and then to travel at the speed of the material 101 through the next 45-degrees until the rams 810*a* and 810*b* strike the material 101.

In yet other example implementations, the controller 228 may be configured to cause the motor 200 to accelerate, decelerate, and/or pause between each pressing cycle to achieve different processing requirements or processing patterns. To achieve cutting patterns having, for example, punched holes that are relatively close to one another, the controller 228 may be configured to cause the rams 810*a* and 810*b* to accelerate after the rams 810*a* and 810*b* leave the pressing position so that the speed of the rams 810*a* and 810*b* is greater than the speed of the material 101. As the rams 810*a* and 810*b* approach the pressing position, the controller 228 causes the rams 810*a* and 810*b* to decelerate so that the rams 810*a* and 810*b* match the translational speed of the material 101.

Figure 11:
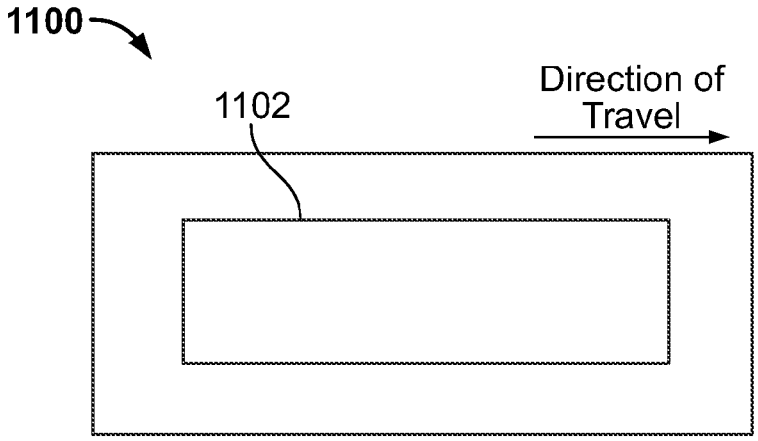
FIG. 11 illustrates an example product that may be produced by the example rotary press system of FIG. 8.

The example press system 800 can be advantageously used to form relatively larger punch patterns in a material than, for example, the rotary press system 102 described above. For example, FIG. 11 illustrates an example material 1100 processed by the example press system 800. The example processed material 900 includes a substantially large cutout portion 1102. In other examples, the rotary press 800 may be configured to form other patterns having other configurations such as, for example, multiple cutout portions, differently shaped cutout portions, etc.

Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. A method of processing a moving material, the method comprising:

moving a material through a first rotary press and a second rotary press spaced from the first rotary press;

driving the first and second rotary presses via a first drive gear directly coupled to a first shaft extending from a housing of a motor;

directly intermeshing the first drive gear with a first gear of the first rotary press and a second gear of the second rotary press;

coupling a second drive gear to the first drive gear via a second shaft, the second drive gear being intermeshed with a third gear of the first rotary press and a fourth gear of the second rotary press, the first and second drive gears to provide a substantially equal amount of torque to the first, second, third and fourth gears; and controlling the first drive gear to cause the first rotary press to contact the material at a first position during a first time interval and the second rotary press to contact the material at a second position during a second time interval, wherein the first and second time intervals define a cycle of the first and second rotary presses.

2. A method as defined in claim 1, wherein moving the material through the first and second rotary presses comprises substantially continuously moving the material.

3. A method as defined in claim 1, wherein the material is a strip material.

4. A method as defined in claim 1, the method further comprising pausing the first and second rotary presses between the first and the second time intervals.

5. An apparatus having machine readable instructions stored thereon that, when executed, cause a machine to implement the method of claim 1.

6. A rotary press system comprising:

a first rotary press and a second rotary press spaced from the first rotary press to process a material;

a drive gear directly coupled to a shaft extending from a housing of a motor so that the drive gear and the shaft of the motor rotate at equivalent speeds, the drive gear being intermeshed with a first gear of the first rotary press and with a second gear of the second rotary press to drive the first and second rotary presses; and a controller operatively coupled to the motor to cause the drive gear to at least one of accelerate or decelerate the first and second gears of the first and second rotary presses to cause the first rotary press to contact the material at a first position during a first time interval and the second rotary press to contact the material at a second position during a second time interval, wherein the first and second time intervals define a cycle of the first and second rotary presses, wherein a speed of the first and second rotary presses substantially matches a speed of the material when the first and second rotary presses are at the respective first and second positions.

7. A rotary press system as defined in claim 6, wherein the first rotary press is structured to contact the material at the first position and the second rotary press is structured to contact the material at the second position while the material is to continuously move through the first and second rotary presses.

8. A rotary press system as defined in claim 6, wherein the material is a strip material, the first rotary press is to punch the strip material, and the second rotary press is to punch or shear the strip material.

9. A rotary press system as defined in claim 6, wherein the first and second rotary presses pause between the first and second time intervals.

10. A method as defined in claim 1, further comprising controlling, via a controller, the first drive gear to accelerate during the first time interval and decelerate during a second portion of the first time interval and accelerate during a first portion of the second time interval and decelerate during a second portion of the second time interval.

11. A method as defined in claim 10, further comprising controlling the first drive gear to rotate at speeds different from a speed of the material.

12. A method as defined in claim 1, wherein the first rotary press has first rams to hold a first tool perpendicular to the material during the cycle, and the second rotary press has second rams to hold a second tool perpendicular to the material during the cycle.

13. A method as defined in claim 1, wherein the motor comprises an electronic motor.

14. A rotary press system as defined in claim 6, wherein the controller is to cause the drive gear to accelerate during a first portion of the first time interval and decelerate during a second portion of the first time interval and accelerate during a first portion of the second time interval and decelerate during a second portion of the second time interval.

15. A rotary press system as defined in claim 6, wherein the first rotary press has rams to hold a first tool perpendicular to the material during an entire rotation of the first rotary press and the second rotary press has second rams to the hold a second tool perpendicular to the material during an entire rotation of the second rotary press.

16. A rotary press system as defined in claim 6, wherein the motor comprises an electric motor.

17. A rotary press system as defined in claim 6, wherein the drive gear is to cause the first and second rotary presses to operate simultaneously.

18. A rotary press system comprising:

a first rotary press and a second rotary press spaced from the first rotary press to process a material;

a first drive gear directly coupled to a first shaft extending from a housing of a motor so that the first drive gear and the first shaft of the motor rotate at equivalent speeds, the first drive gear being intermeshed with a first gear of the first rotary press and with a second gear of the second rotary press to drive the first and second rotary presses;

a second drive gear coupled to the first drive gear via a second shaft, the second drive gear being intermeshed with a third gear of the first rotary press and a fourth gear of the second rotary press, the first and second drive gears to provide a substantially equal amount of torque to the first, second, third and fourth gears; and a controller operatively coupled to the motor to cause the first drive gear to at least one of accelerate or decelerate the first and second gears of the first and second rotary presses to cause the first rotary press to contact the material at a first position during a first time interval and the second rotary press to contact the material at a second position during a second time interval, wherein the first and second time intervals define a cycle of the first and second rotary presses.

19. A method of claim 1, further comprising rotating the first drive gear and the shaft of the motor at equivalent speeds.

20. A rotary press system of claim 15, wherein the first rotary press has a first upper ram and a first lower ram to support the first tool and the second rotary press has a second upper ram and a second lower ram to support the second tool.

21. A rotary press system as defined in claim 20, wherein the first gear comprises a first lower spur gear of the first lower ram and the second gear comprises a second lower spur gear of the second lower ram.

22. A rotary press system as defined in claim 18, wherein the controller controls the speeds of the first and second rotary presses to rotate at speeds different from a speed of the material.

* * * * *

UNITED STATES PATENT AND TRADEMARK OFFICE

CERTIFICATE OF CORRECTION

PATENT NO. : 8,833,217 B2
APPLICATION NO. : 12/139113
DATED : September 16, 2014
INVENTOR(S) : Smith It is certified that error appears in the above-identified patent and that said Letters Patent is hereby corrected as shown below:

In the Claims

Column 18, line 15 Claim 15 delete the word “the” between “to” and “hold”.

Signed and Sealed this
Third Day of February, 2015

Michelle K. Lee

Michelle K. Lee
*Deputy Director of the United States Patent and Trademark Office*